US011186410B2

(12) United States Patent
Erickson et al.

(10) Patent No.: US 11,186,410 B2
(45) Date of Patent: Nov. 30, 2021

(54) FLEXIBLE DYNAMIC PACKAGING OF PRODUCT ENTITIES

(71) Applicant: INTERNATIONAL BUSINESS MACHINES CORPORATION, Armonk, NY (US)

(72) Inventors: Steven C Erickson, Rochester, MN (US); Ryan Paske, Rochester, MN (US); Benjamin Luedeman, Rochester, MN (US); Michael J MacPherson, Elgin, MN (US); Clinton W Erie, Adams, MN (US)

(73) Assignee: International Business Machines Corporation, Armonk, NY (US)

( * ) Notice: Subject to any disclaimer, the term of this patent is extended or adjusted under 35 U.S.C. 154(b) by 32 days.

(21) Appl. No.: 16/181,238

(22) Filed: Nov. 5, 2018

(65) Prior Publication Data

US 2020/0140142 A1 May 7, 2020

(51) Int. Cl.
*B65D 21/02* (2006.01)
*B65D 77/04* (2006.01)

(52) U.S. Cl.
CPC ..... *B65D 21/0212* (2013.01); *B65D 77/0466* (2013.01)

(58) Field of Classification Search
CPC ..... B65D 81/107; B65D 81/1075; B65D 81/113; B65D 77/0466; B65D 21/0212; B65D 2571/00055; B65D 2571/00043; B65D 2571/00111; B65D 71/0096; B65D 11/1873; B65D 21/083
USPC ..... 206/523, 509, 511, 585, 577
See application file for complete search history.

(56) References Cited

U.S. PATENT DOCUMENTS 3,591,212 A * 7/1971 Rhyne ..... B27M 1/02 217/65
5,323,911 A * 6/1994 Johnston ..... B65D 19/16 206/526
6,079,580 A * 6/2000 Garton ..... B65D 88/128 206/509

(Continued)

FOREIGN PATENT DOCUMENTS

CA 2952030 6/2017

OTHER PUBLICATIONS

Bud Industries, Enclosure Design Tips Handbook, 2005, p. 9, https://www.newark.com/wcsstore/ExtendedSitesCatalogAssetStore/cms/asset/images/americas/common/storefront/bud/Enclosure-handbook.pdf.

*Primary Examiner* — J. Gregory Pickett
*Assistant Examiner* — Jenine Pagan
(74) *Attorney, Agent, or Firm* — Kunzler Bean & Adamson; Bruce R. Needham

(57) ABSTRACT

A modular shipping container includes a layer of two side pieces positioned against sides of a component of several components with a same width. The side piece include pegs protruding from a top of each side piece and bottom openings in a bottom of each side piece sized and positioned to conform to the pegs. The container includes one or more end pieces on the same layer as the side pieces. Each end of the end piece is shaped to attach to an end of a side piece and is shaped to maintain a width between the side pieces. A length of an area formed by the side pieces and end pieces is sized to accommodate a maximum length of each component. The components have a height that is an integer number of standard units and a height of the side pieces matches an integral number of the standard units.

17 Claims, 7 Drawing Sheets

(56) References Cited

U.S. PATENT DOCUMENTS 7,124,890 B2 * 10/2006 McLeod ..... B65D 5/0015 206/509
7,278,273 B1 10/2007 Whitted et al.
7,320,403 B2 * 1/2008 May, Jr. ..... B65D 85/64 206/320
8,077,457 B2 12/2011 Gauthier et al.
8,794,463 B2 * 8/2014 Rio Gonzalez ..... B65D 5/323 220/4.28
8,833,573 B2 9/2014 Tomaszewski et al.
8,976,515 B2 3/2015 Schmitt et al.
9,676,509 B2 * 6/2017 Shin ..... B65D 1/34
9,930,869 B2 * 4/2018 Linder ..... A01K 49/00
2007/0075043 A1 * 4/2007 Riogonzalez ..... B65D 85/345 217/13
2007/0144936 A1 * 6/2007 Stegner ..... B65D 81/107 206/591
2007/0205117 A1 * 9/2007 Kong ..... B65D 81/113 206/96
2008/0006596 A1 1/2008 Palmeri
2010/0018966 A1 * 1/2010 Roberts, Sr. ..... B65D 19/18 220/4.31
2011/0010313 A1 * 1/2011 Ozias ..... G06Q 99/00 705/500
2011/0308979 A1 * 12/2011 Mitsuhashi ..... B65D 81/057 206/320
2012/0241351 A1 * 9/2012 Tsukii ..... B65D 81/107 206/521
2013/0062241 A1 * 3/2013 Blay Orenga ..... B65D 9/12 206/509
2013/0146606 A1 * 6/2013 Blay Orenga ..... B65D 11/1873 220/628
2015/0360836 A1 * 12/2015 Shi ..... B65D 61/00 206/316.1
2017/0043937 A1 * 2/2017 Lantz ..... B65D 81/09

* cited by examiner

Top View

FLEXIBLE DYNAMIC PACKAGING OF PRODUCT ENTITIES

BACKGROUND

The subject matter disclosed herein relates to shipping components and more particularly relates to a modular shipping container for shipping the components.

A typical method of shipping components is for each component to be shipped in a separate box or container. Some components, such as components that fit into a standard width rack may be best shipped in a stack with a particular order to assist a customer when installing the components. Components that fit into a rack may also have cabling between the components where shipping in a particular order in a stack may facilitate pre-installation of the cables. Individual boxes or containers do not facilitate pre-installation of cables. Where the components are stacked, a custom box may be inserted over the box, however, having custom boxes is relatively expensive and inconvenient and is not very reusable. Where a customer orders a rack, the components may be shipped in the rack. However, some customers may not want to purchase a rack from the supplier of the components. In some cases, the supplier could provide a free rack for shipping, but this is an expensive option. Most shipping options for the components do not allow for reuse of the shipping containers.

SUMMARY

A modular shipping container includes a layer of two side pieces positioned against each side of a component of a plurality of components. Each of the plurality of components has a same width and the side piece include two or more pegs protruding from a top of each side piece. The side piece includes bottom openings in a bottom of each side piece and each bottom opening of a side piece is sized and positioned to conform to a peg of a side piece positioned below the side piece. The modular shipping container includes one or more end pieces on the same layer as the two side pieces. Each end piece has two ends and each end of the end piece is shaped to attach to an end of a side piece of the two side pieces and is shaped to maintain a width between the two side pieces to match the width of the plurality of components. A length of an area formed by the two side pieces and an end piece on each end of the two side pieces is sized to accommodate a maximum length of each component of the plurality of components. The plurality of components each have height that is an integer number of standard units and a height of the two side pieces matches an integral number of the standard units.

Another modular shipping container includes two or more layers. Each layer has two side pieces positioned against each side of a component of a plurality of components. Each of the plurality of components has a same width. The side piece includes two or more pegs protruding from a top of each side piece. The side piece includes bottom openings in a bottom of each side piece and each bottom opening of a side piece is sized and positioned to conform to a peg of a side piece positioned below the side piece. The modular shipping container includes a top piece with top openings sized and located to conform to the pegs protruding from the top of the two side pieces on a top layer of the two or more layers. The top piece has a length that at least matches a length of the side pieces. A length of an area formed by a width between the two side pieces and a length of the two side pieces has a length sized to accommodate a maximum length of each component of the plurality of components. The plurality of components each have height that is an integer number of standard units and a height of the two side pieces matches an integral number of the standard units.

Another modular shipping container includes a layer of two side pieces positioned against each side of a component of a plurality of components. Each of the plurality of components has a same width and each side piece has two or more pegs protruding from a top of each side piece. Each side piece has bottom openings in a bottom of each side piece and each bottom opening of a side piece is sized and positioned to conform to a peg of a side piece positioned below the side piece. The modular shipping container includes one or more end pieces on the same layer as the two side pieces. Each end piece has two ends and each end of the end piece is shaped to attach to an end of a side piece of the two side pieces and is shaped to maintain a width between the two side pieces to match the width of the plurality of components. Each side piece connects to an end piece via an end opening and a conforming protrusion. When the protrusion is inserted into the end opening the side piece and end piece are connected to prevent the end piece from pulling away from the side piece.

In the embodiment, the modular shipping container includes a top piece. The top piece includes top openings sized and located to conform to the pegs protruding from the top of the two side pieces on a top layer. The top piece has a length that at least matches a length of the side pieces. The modular shipping container includes a bottom piece. The two side pieces of a bottom layer are attached to the bottom piece. Each side piece has two or more vertical holes where the bottom piece is attached to the two side pieces of the bottom layer via the vertical holes. A length of an area formed by the two side pieces and an end piece on each end of the two side pieces has a length sized to accommodate a maximum length of each component of the plurality of components. A joint between a side piece and an end piece of a layer includes an exposed lip at an end of the side piece where a protrusion of a component at the layer rests against the lip maintaining the component in a fixed position in a direction along the length of the component. The protrusion of the component is attached to the lip of the side piece. The plurality of components each have height that is an integer number of standard units and a height of the two side pieces matches a height of the one or more end pieces and the height of the side and end pieces matches an integral number of the standard units.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION OF THE INVENTION

Figure 1:
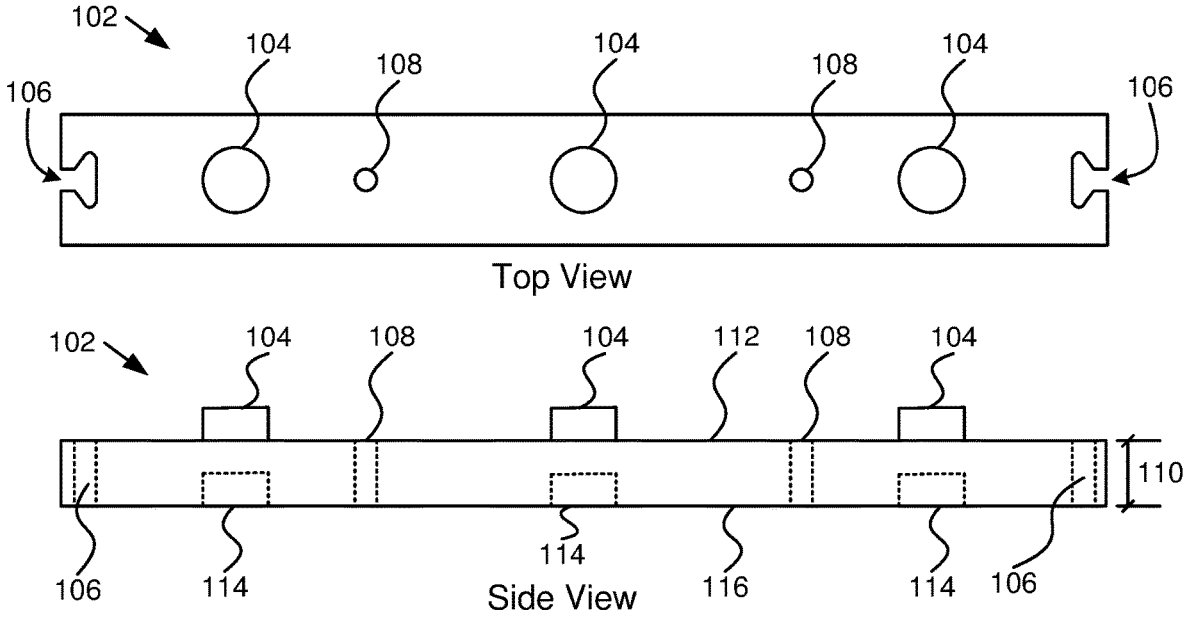
FIG. 1 is a schematic block diagram illustrating a top view and a side view of one embodiment of a side piece of a modular shipping container.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

The description of elements in each figure may refer to elements of proceeding figures. Like numbers refer to like elements in all figures, including alternate embodiments of like elements.

A modular shipping container includes a layer of two side pieces positioned against each side of a component of a plurality of components. Each of the plurality of components has a same width and the side piece include two or more pegs protruding from a top of each side piece. The side piece includes bottom openings in a bottom of each side piece and each bottom opening of a side piece is sized and positioned to conform to a peg of a side piece positioned below the side piece. The modular shipping container includes one or more end pieces on the same layer as the two side pieces. Each end piece has two ends and each end of the end piece is shaped to attach to an end of a side piece of the two side pieces and is shaped to maintain a width between the two side pieces to match the width of the plurality of components. A length of an area formed by the two side pieces and an end piece on each end of the two side pieces is sized to accommodate a maximum length of each component of the plurality of components. The plurality of components each have height that is an integer number of standard units and a height of the two side pieces matches an integral number of the standard units.

In some embodiments, the modular shipping container includes a top piece. The top piece includes top openings sized and located to conform to the pegs protruding from the top of the two side pieces on a top layer and, in some embodiments, the top piece has a length that at least matches a length of the side pieces. In other embodiments, the top piece is sized to cover the side pieces and the end pieces of a layer. In other embodiments, the modular shipping container includes a bottom piece where the two side pieces of a bottom layer are attached to the bottom piece. In further embodiments, each side piece has two or more vertical holes where the bottom piece is attached to the two side pieces of the bottom layer via the vertical holes. In other embodiments, the bottom piece is a pallet adjacent to the two side pieces of the bottom layer or a planar element that fits between a pallet and the two side pieces of the bottom layer.

In some embodiments, each side piece connects to an end piece via an end opening and a conforming protrusion. When the protrusion is inserted into the end opening, the side piece and end piece are connected to prevent the end piece from pulling away from the side piece. In other embodiments, each end opening for connecting a side piece with an end piece extends vertically through the side piece or the end piece and the corresponding protrusion is shaped to slide vertically into the end opening to conform to the end opening to prevent movement of the end piece away from the side piece.

In other embodiments, a joint between a side piece and an end piece of a layer includes an exposed lip at an end of the side piece and a protrusion of a component at the layer rests against the lip maintaining the component in a fixed position in a direction along the length of the component. In other embodiments, the protrusion of the component is attached to the lip of the side piece. In other embodiments, each side piece is configured to fit on either side of the component on a same layer as the side piece. In other embodiments, each end piece is configured to fit on either end of the component on the same layer as the end piece.

In some embodiments, an assembled modular shipping container includes a bottom piece, two or more layers where each layer has at least two side pieces, and a top piece and the modular shipping container includes one or more bands that extend from the bottom piece around the side pieces and top piece and hold the top piece and side pieces to the bottom piece. In other embodiments, each end piece is configured to extend away from a component on the same layer of the end piece creating a cable space between the end piece and the component. In other embodiments, the end piece includes a cable attachment that secures a cable to a side of the end piece adjacent to the component.

Another modular shipping container includes two or more layers. Each layer has two side pieces positioned against each side of a component of a plurality of components. Each of the plurality of components has a same width. The side piece includes two or more pegs protruding from a top of each side piece. The side piece includes bottom openings in a bottom of each side piece and each bottom opening of a side piece is sized and positioned to conform to a peg of a side piece positioned below the side piece. The modular shipping container includes a top piece with top openings sized and located to conform to the pegs protruding from the top of the two side pieces on a top layer of the two or more layers. The top piece has a length that at least matches a length of the side pieces. A length of an area formed by a width between the two side pieces and a length of the two side pieces has a length sized to accommodate a maximum length of each component of the plurality of components. The plurality of components each have height that is an integer number of standard units and a height of the two side pieces matches an integral number of the standard units.

In some embodiments, the modular shipping container includes an end piece on a same layer as two side pieces. The end piece attaches to an end of the two side pieces and extends across a component on the same layer as the side pieces. The end piece has two ends and each end of the end piece is shaped to attach to an end of a side piece of the side pieces of the layer and is shaped to maintain a width between the two side pieces to match the width of the plurality of components. A height of the end piece matches a height of the side pieces. In other embodiments, the modular shipping container includes a bottom piece where the two side pieces of a bottom layer are attached to the bottom piece. The bottom piece is a pallet adjacent to the two side pieces of the bottom layer or a planar element that fits between a pallet and the two side pieces of the bottom layer. The modular shipping container includes one or more bands extending around the side pieces and top piece securing the side pieces and top piece to the bottom piece. In other embodiments, a joint between a side piece and an end piece of a layer has an exposed lip at an end of the side piece where a protrusion of a component at the layer rests against the lip maintaining the component in a fixed position in a direction along the length of the component and the protrusion of the component is attached to the lip of the side piece.

Another modular shipping container includes a layer of two side pieces positioned against each side of a component of a plurality of components. Each of the plurality of components has a same width and each side piece has two or more pegs protruding from a top of each side piece. Each side piece has bottom openings in a bottom of each side piece and each bottom opening of a side piece is sized and positioned to conform to a peg of a side piece positioned below the side piece. The modular shipping container includes one or more end pieces on the same layer as the two side pieces. Each end piece has two ends and each end of the end piece is shaped to attach to an end of a side piece of the two side pieces and is shaped to maintain a width between the two side pieces to match the width of the plurality of components. Each side piece connects to an end piece via an end opening and a conforming protrusion. When the protrusion is inserted into the end opening the side piece and end piece are connected to prevent the end piece from pulling away from the side piece.

In the embodiment, the modular shipping container includes a top piece. The top piece includes top openings sized and located to conform to the pegs protruding from the top of the two side pieces on a top layer. The top piece has a length that at least matches a length of the side pieces. The modular shipping container includes a bottom piece. The two side pieces of a bottom layer are attached to the bottom piece. Each side piece has two or more vertical holes where the bottom piece is attached to the two side pieces of the bottom layer via the vertical holes. A length of an area formed by the two side pieces and an end piece on each end of the two side pieces has a length sized to accommodate a maximum length of each component of the plurality of components. A joint between a side piece and an end piece of a layer includes an exposed lip at an end of the side piece where a protrusion of a component at the layer rests against the lip maintaining the component in a fixed position in a direction along the length of the component. The protrusion of the component is attached to the lip of the side piece. The plurality of components each have height that is an integer number of standard units and a height of the two side pieces matches a height of the one or more end pieces and the height of the side and end pieces matches an integral number of the standard units.

FIG. 1 is a schematic block diagram illustrating a top view and a side view of one embodiment of a side piece 102 of a modular shipping container. The modular shipping container includes a layer of two side pieces 102 positioned against each side of a component of a plurality of components. Each of the plurality of components, in some embodiments, has a same width. For example, each component may be configured to fit in an Electronic Industries Alliance ("EIA") Standard 310-D, 19-inch (48.3 centimeter) rack. In other embodiments, the component has a different width than a 19-inch rack, but each of the plurality of components have a same width. The components, in some embodiments, are computing components, such as a blade server, a storage area network ("SAN") server, a storage device, a switch, a router, and the like. In other embodiments, the components are electrical components, such as a display, a meter, audio equipment, video equipment, an uninterruptable power supply ("UPS"), and the like. In other embodiments, the components are mechanical components. In some embodiments, components of various types with a same width are shipped with the module shipping container. One of skill in the art will recognize other components suitable for the module shipping container.

Each side piece 102 includes two or more pegs 104 protruding from a top 112 of each side piece 102. In addition, each side piece includes bottom openings 114 in a bottom 116 of each side piece 102. Each bottom opening 114 in the bottom 116 of a side piece 102 is sized and positioned to conform to a peg 104 of a side piece 102 positioned below the side piece 102 so that side pieces 102 are capable of being stacked and/or do not move horizontally relative to each other. In some embodiments, the pegs 104 are round. In other embodiments, the pegs 104 are oval-shaped, square, star-shaped or other shape and the bottom openings 114 in the bottom 116 of each side piece 102 matches the shape of the peg 104. In some embodiments, modular shipping containers are of various sizes for varying sizes of components and different side pieces 102 for the various modular shipping containers include pegs 104 of different shapes to distinguish between the modular shipping containers.

In some embodiments, the pegs 104 are uniform in a vertical dimension and the bottom openings 114 are also uniform in a vertical dimension and conform to the pegs 104 to minimize horizontal movement between stacked side pieces 102. In other embodiments, the pegs 104 and bottom openings 114 are shaped for a compression fit where a peg 104 inserted into a bottom opening 114 resists separating once side pieces 102 are stacked. In other embodiments, the pegs 104 and bottom openings 114 are sized for a looser fit for an easier separation and other means are used to secure the side pieces 102 together. In other embodiments, the bottom openings 114 and corresponding pegs 104 include a locking mechanism that holds a peg 104 in a bottom opening 114 after insertion to a greater degree than a compression fit.

Each end of a side piece 102 includes an end opening 106 shaped to connect with an end piece 202 discussed below in relation to FIG. 2. In some embodiments, each side piece 102 includes two or more vertical holes 108, where a bottom piece 502 (see FIG. 5) is attached to the two side pieces 102 of a bottom layer via the vertical holes 108, which is discussed in more detail below. In addition, a height 110 of each side piece 102 matches a height 210 of each end piece 202, which is discussed below in relation to FIG. 2.

Figure 2:
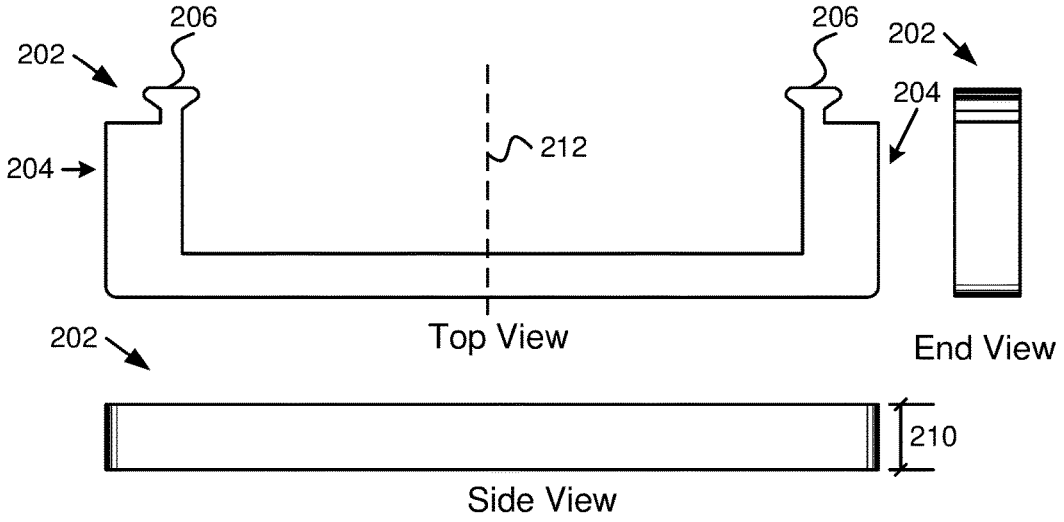
FIG. 2 is a schematic block diagram illustrating a top view, a side view and an end view of one embodiment of an end piece of a modular shipping container.

FIG. 2 is a schematic block diagram illustrating a top view, a side view and an end view of one embodiment of an end piece 202 of a modular shipping container. A modular shipping container includes one or more end pieces 202 on the same layer as two side pieces 102. Each end piece 202 includes two ends 204 and each end 204 of the end piece 202 is shaped to attach to an end of a side piece 102 of the two side pieces 102 of a layer and is shaped to maintain a width between the two side pieces 102 to match the width of the plurality of components. For example, an end piece 202 may attach to the side pieces 102 at a specific point so that the side pieces 102 have an interior that is a specific width to accommodate the width of a component. In some embodiments, the end piece 202 attaches to the side pieces 102 to maintain an interior width that closely conforms to a width of the component.

In one embodiment, each side piece 102 connects to an end piece 202 via an end opening 106 and a conforming protrusion 206, where when the protrusion 206 is inserted into the end opening 106, the side piece 102 and end piece 202 are connected to prevent the end piece 202 from pulling away from the side piece 102. In some embodiments, each end opening 106 for connecting a side piece 102 with an end piece 202 extends vertically through the side piece 102 or the end piece 202 and the corresponding protrusion 206 is shaped to slide vertically into the end opening 106 to conform to the end opening 106 to prevent movement of the end piece 202 away from the side piece 102. In the embodiments depicted in FIGS. 1 and 2, the protrusion 206 is on the end piece 202 and the end opening 106 is in the side piece 102. In other embodiments, the end opening 106 is in the end piece 202 and the protrusion 206 is on an end of the side piece 102.

In some embodiments, the end opening 106 is shaped to be narrower closer to the end than a portion of the end opening 106 further away from the end and the protrusion 206 is narrower closer to the end piece 202 than at an end distal to the end piece 202. In some examples, the protrusion 206 and end opening 106 are similar to puzzle pieces or are a T-shape. In other embodiments, the protrusion 206 and end opening 106 are shaped to connect with a friction fit sufficient to deter the end piece 202 pulling away from a side piece 102. In other embodiments, the end piece 202 and side piece 102 include an additional connector, such as a screw, a staple, a latch, a nail, etc. in addition to the protrusion 206 and end opening 106. For example, the protrusion 206 and end opening 106 may connect to maintain positioning of the end piece 202 and side pieces 102 while the additional connector secures the end piece 202 to the side pieces 102.

In other embodiments, the end piece 202 and the side pieces 102 have a shape other than an end opening 106 and a protrusion 206 to maintain separation of the side pieces 102. For example, the end piece 202 and side pieces 102 may include a wavy section, a tongue and groove connection, etc. for positioning and/or connection and may include connectors as necessary for securing an end piece 202 to side pieces 102. One of skill in the art will recognize other ways to connect an end piece 202 to two side pieces 102 to secure the end piece 202 to the side pieces 102 and to maintain a particular width inside the side pieces 102 to conform to a width of a component.

In some embodiments, each end opening 106 for connecting a side piece 102 with an end piece 202 extends vertically through the side piece 102 or the end piece 202, depending on where the protrusion 206 is located, and the corresponding protrusion 206 is shaped to slide vertically into the end opening 106 to conform to the end opening 106 to prevent movement of the end piece 202 away from the side piece 102. For example, where the protrusion 206 is on the end piece 202, as depicted in FIG. 2, the side piece 102 may include an end opening 106 that is uniform in a vertical direction and extends through or partially through the side piece 102 so that the protrusion 206 can be inserted vertically into the end opening 106. In some embodiments, the end opening 106 extends through the side piece 102 or end piece 202. In other embodiments, the end opening 106 extends partially through the side piece 102 or end piece 202 and the protrusion 206 is sized to fit in the partial end opening 106.

As discussed above, in some embodiments, a height 110 of each side piece 102 matches a height 210 of each end piece 202. Having the height 110 of the side pieces 102 match the height 210 of the end pieces 202 be the same allows for convenient stacking of layers of side pieces 102 and end pieces 202. In another embodiment, each end piece 202 has a height 210 that is less than the height 110 of the side pieces 102. Each layer includes two side pieces 102 and may or may not include end pieces 202. Where end pieces 202 are included in adjacent layers, having end pieces 202 that have a height 210 that is the same or less than the height 110 of the side pieces 102 allows for stacking of the layers of side pieces 102 and/or end pieces 202.

In some embodiments, the plurality of components each have height that is an integer number of standard units and a height 110 of the two side pieces 102 matches an integral number of the standard units. For example, where the components are sized with a vertical dimension in standard increments of an EIA-310-D unit (e.g. 1 U, 2 U, 3 U, etc.), the height 110 of the side pieces 102 may be a single unit (e.g. 1 U). For example, 1 U may be 1.75 inches or 44.45 millimeters. Thus, a component that has a height of 3 U can be packaged in three layers of side pieces 102 and optionally end pieces 202. Having a height 110 of the side pieces 102 being a standard unit is advantageous because an integral number of layers can be used to package a component. For example, if the component has a height of 3 U and the side pieces are 1 U then three layers can be used for packaging of the component. Other components with a different type of units or a different unit height may also be used and are anticipated herein.

In some embodiments, each side piece 102 is configured to fit on either side of the component on a same layer as the side piece 102. For example, the side piece 102 may be symmetrical about an axis running from end opening 106 to end opening 106 so that the side piece 102 may be used on the left or right of the component. Having a symmetrical side piece 102 is advantageous because only one type of side piece 102 is required for the modular shipping container, which makes manufacturing of the side pieces 102 less expensive.

Similarly, in some embodiments each end piece 202 is configured to fit on either end of the component on the same layer as the end piece 202. For example, the end piece 202 may be symmetrical about an axis 212 between the two ends 204 of the end piece 202 so that the end piece 202 can be used on either end of the component, which makes manufacturing of the end pieces 202 less expensive.

The side pieces 102 and end pieces 202 may be made of wood, plastic, cardboard or other material strong enough to protect the components during shipping. For example, the side pieces 102 and end pieces 202 may be made by superplastic forming. In another embodiment, the side pieces 102 and end pieces 202 may be made by pressing paper pulp into a mold to form cardboard pieces 102, 202. In other embodiments, the side pieces 102 and end pieces 202 may be made of wood and cut into shape. One of skill in the art will recognize other materials and ways to make the side pieces 102 and end pieces 202 to protect the components during shipping.

Figure 3:
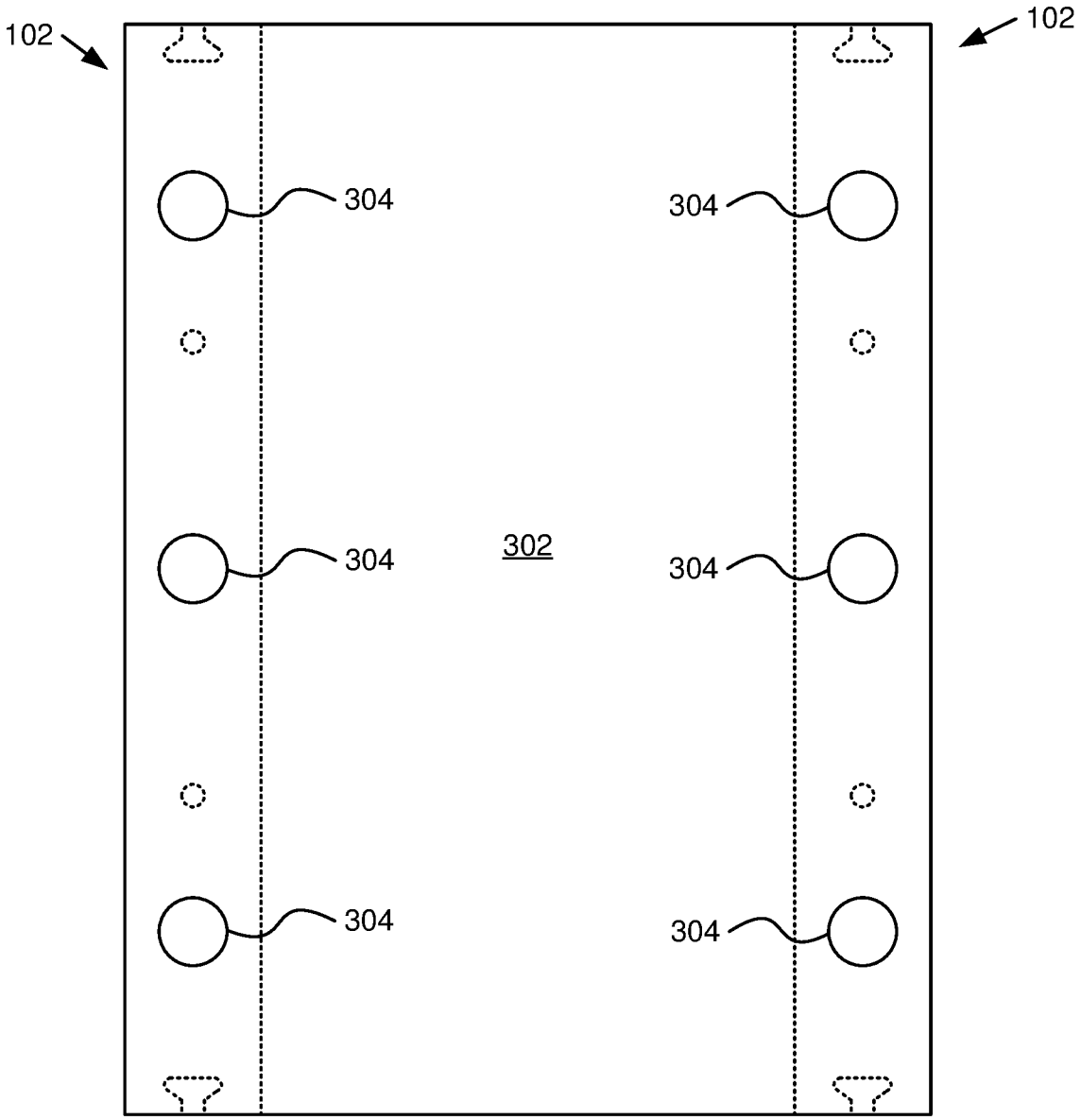
FIG. 3 is a schematic block diagram illustrating a top view of one embodiment of a top piece of a modular shipping container.

FIG. 3 is a schematic block diagram illustrating a top view of one embodiment of a top piece 302 of a modular shipping container. In some embodiments, the top piece 302 includes top openings 304 sized and located to conform to the pegs 104 protruding from the top 112 of the two side pieces 102 on a top layer. In other embodiments, the top piece 302 is secured to the pegs 104. For example, a piece extending across the top openings 304, such as a piece of wood, plastic, etc., may be screwed to the pegs 104 and to the top piece 302. In other embodiments, the piece extending across the top of the pegs 104 may be secured using other fasteners.

The top piece 302 has a width sized to maintain a width between the two side pieces 102 to match the width of the plurality of components. For example, side pieces 102 and possibly some end pieces 202 may be placed in layers beside the plurality of components and then the top piece 302 is placed on a top layer of side pieces 102 and/or end pieces 202, which may hold the side pieces 102 in place. Where end pieces 202 are used, the end pieces 202 may also hold the side pieces 102 in place. In addition, the top piece 302 covers the components for protection of the components.

In some embodiments, the top piece 302 is flat on the top and the bottom. In other embodiments, the top piece 302 includes packing material, padding or other material to further protect the components. In other embodiments, the top of the top piece 302 extends upward, has a shipping receipt pouch, or the like. One of skill in the art will recognize other options for the top piece 302.

The top piece 302, in some embodiments, has a length that at least matches a length of the side pieces. In other embodiments, the top piece 302 is shorter. While the top piece 302 is depicted with a length (vertical dimension in FIG. 3) that matches the side pieces 102, in some embodiments, the top piece 302 is sized to cover the side pieces 102 and the end pieces 202 of a layer. In other embodiments, the top piece 302 is sized to cover the side pieces 102 and just a portion of the end pieces 202 of a layer. In other embodiments, the top piece 302 is sized to cover the side pieces 102 and a component of the maximum length. One of skill in the art will recognize other appropriate lengths of the top piece 302.

In various embodiments, the top piece 302 may be made of wood, plastic, cardboard, metal, fiberglass, or the like. The material for the top piece 302, in some embodiments, is chosen based on expected shipping conditions, vibration, shock, weight of the components, etc. One of skill in the art will recognize other materials and ways to make the top piece 302 to protect the components.

Figure 4:
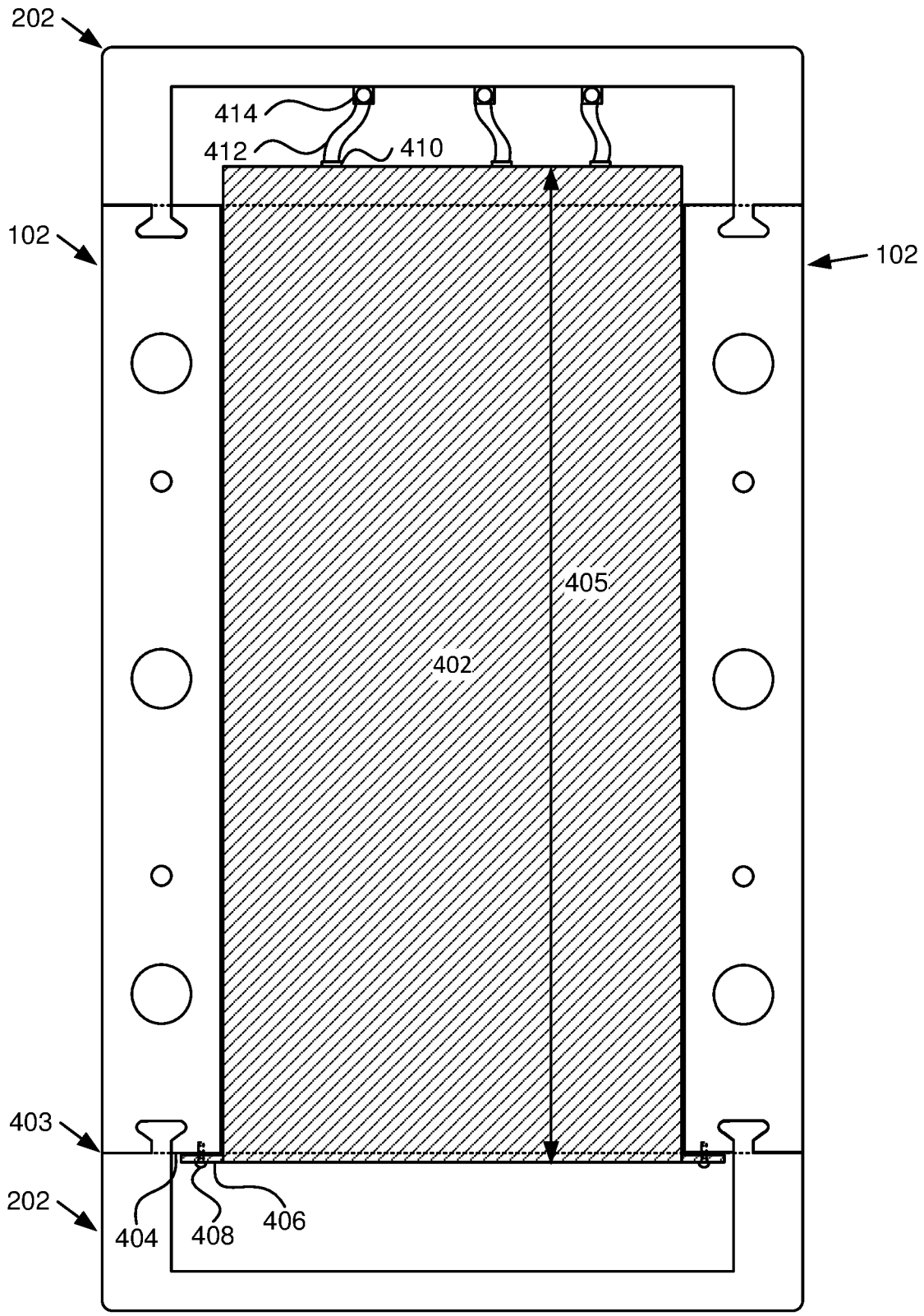
FIG. 4 is a schematic block diagram illustrating one embodiment of two side pieces connected to two end pieces of a modular shipping container and surrounding a component.

FIG. 4 is a schematic block diagram illustrating one embodiment of two side pieces 102 connected to two end pieces 202 of a modular shipping container and surrounding a component 402. In some embodiments, a length of an area formed by the two side pieces 102 and an end piece 202 on each end of the two side pieces 102 is sized to accommodate a maximum length of each component 402 of the plurality of components 402. For example, while each component 402 has a width that is the same, the lengths of the various components 402 within the modular shipping container may be within a range from a minimum length to a maximum length.

In some embodiments, a joint 403 between a side piece 102 and an end piece 202 of a layer has an exposed lip 404 at an end of the side piece 102 where a protrusion 406 of a component 402 at the layer rests against the lip 404 maintaining the component 402 in a fixed position in a direction along the length 405 of the component 402. As depicted in FIG. 4, the component 402 includes a protrusion 406 is located on both sides of the component 402 and rests against the lip 404 so the component is blocked from moving past the lip 404. In some embodiments, the protrusion 406 of the component 402 is attached to the lip 404 of the side piece 102, which helps to prevent the component 402 from moving either direction along the length 405 of the component 402.

In the depicted embodiment, the protrusion 406 of the component 402 is connected to the lip 404 of the side piece 102 with a screw 408. In other embodiments, the protrusion 406 of the component 402 is connected to the lip 404 of the side piece 102 with a bolt, a pin or other fastener known to those of skill in the art. In some embodiments, the protrusion 406 of the component 402 is used to secure the component 402 in a rack, such as a 19-inch rack and the lip 404 is sized to be similar to a front face of a rack so the component 402 connects to the lip 404 of the side piece 102 in a similar way that the component 402 is connected to the rack.

In some embodiments, the component 402 is separated from one or both end pieces 202 forming a cable space along an end of the component 402 between the component 402 and the end piece 202. For example, the component may include connectors 410 for cables 412 to plug into the connectors 410. In some embodiments, the end piece 202 includes a cable attachment 414 that secures a cable 412 to a side of the end piece 202 adjacent to the component 402. The cable attachment 414 may include a hook and loop fastener, a cable tie, a strap, a clamp, or other device useful to secure a cable 412 to the end piece 202. The cable attachment 414 is useful for maintaining the cable 412 for assembly of the components 402 within the modular shipping container, for securing the cables 412 during shipping, for separating the cables 412, and the like.

Figure 5:
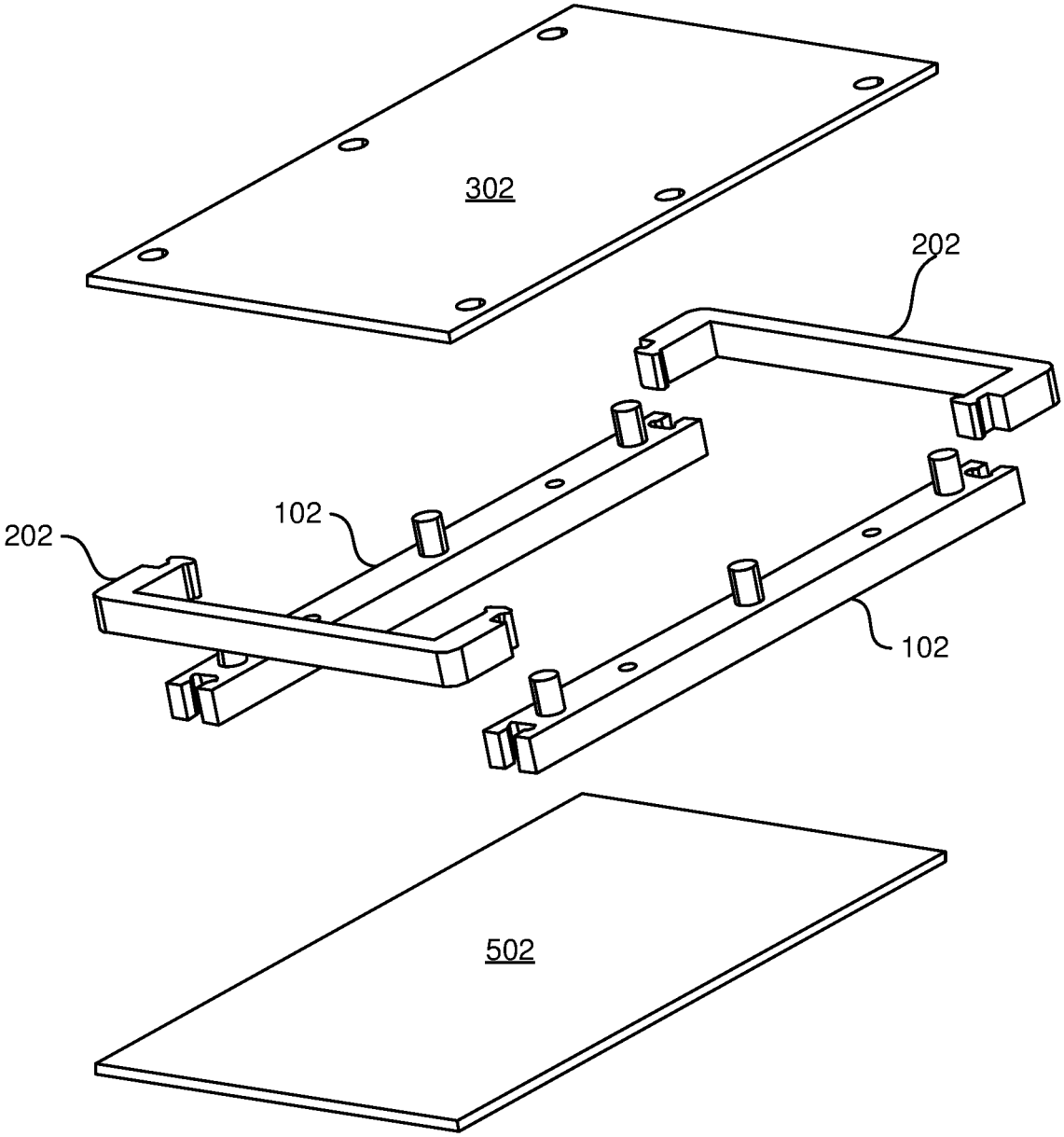
FIG. 5 is a perspective view diagram of a top piece, two side pieces, two end pieces and a bottom piece of a modular shipping container.

FIG. 5 is a perspective view diagram of a top piece 302, two side pieces 102, two end pieces 202 and a bottom piece 502 of a modular shipping container. In some embodiments, the two side pieces 102 of a bottom layer are attached to the bottom piece 502. For example, a fastener may extend through the side pieces 102 of the bottom layer to secure the side pieces 102 to the bottom piece 502. In some embodiments, each side piece 102 includes two or more vertical holes 108, where the bottom piece 502 is attached to the two side pieces 102 of the bottom layer via the vertical holes 108. For example, screws, bolts, etc. may extend through the vertical holes 108 to secure the side pieces 102 to the bottom piece 502. In other embodiments, one or two end pieces 202 of the first layer are also secured to the bottom piece 502 and the end pieces 202 may include vertical holes similar to the vertical holes 108 of the side pieces 102.

In one embodiment, one or two end pieces 202 are connected to the side pieces 102 of the first layer to establish a width of the side pieces 102 before securing the side pieces 102 and/or end pieces 202 to the bottom piece 502. In another embodiment, once the side pieces 102 are secured to the bottom piece 502 on a first layer, one or two end pieces 202 may be connected to the side pieces 102 of the first layer. A second layer that includes at least two side pieces 102 may then be placed on the first layer so that pegs 104 of the first layer are inserted into bottom openings 114 of the two side pieces 102 of the second layer. One or two end pieces 202, in some embodiments, are included in the second layer. A component 402 may be placed between the side pieces 102 and end pieces 202. Layers of side pieces 102 and/or end pieces 202 are then stacked while components 402 are stacked within the side pieces 102 and end pieces 202 and a top piece 302 is placed over the layers of side pieces 102 and/or end pieces 202, which, in some embodiments, completes a modular shipping container.

In some embodiments, for example where end pieces 202 are not used in bottom layers, securing the first layer of two side pieces 102 to the bottom piece 502 at a width of the components 402 maintains the width at the bottom and placing the top piece 302 on the layers of side pieces 102 then holds the side pieces 102 of the top layers at a correct width. In other embodiments, one or more end pieces 202 maintain the proper width of the side pieces 102.

Figure 6:
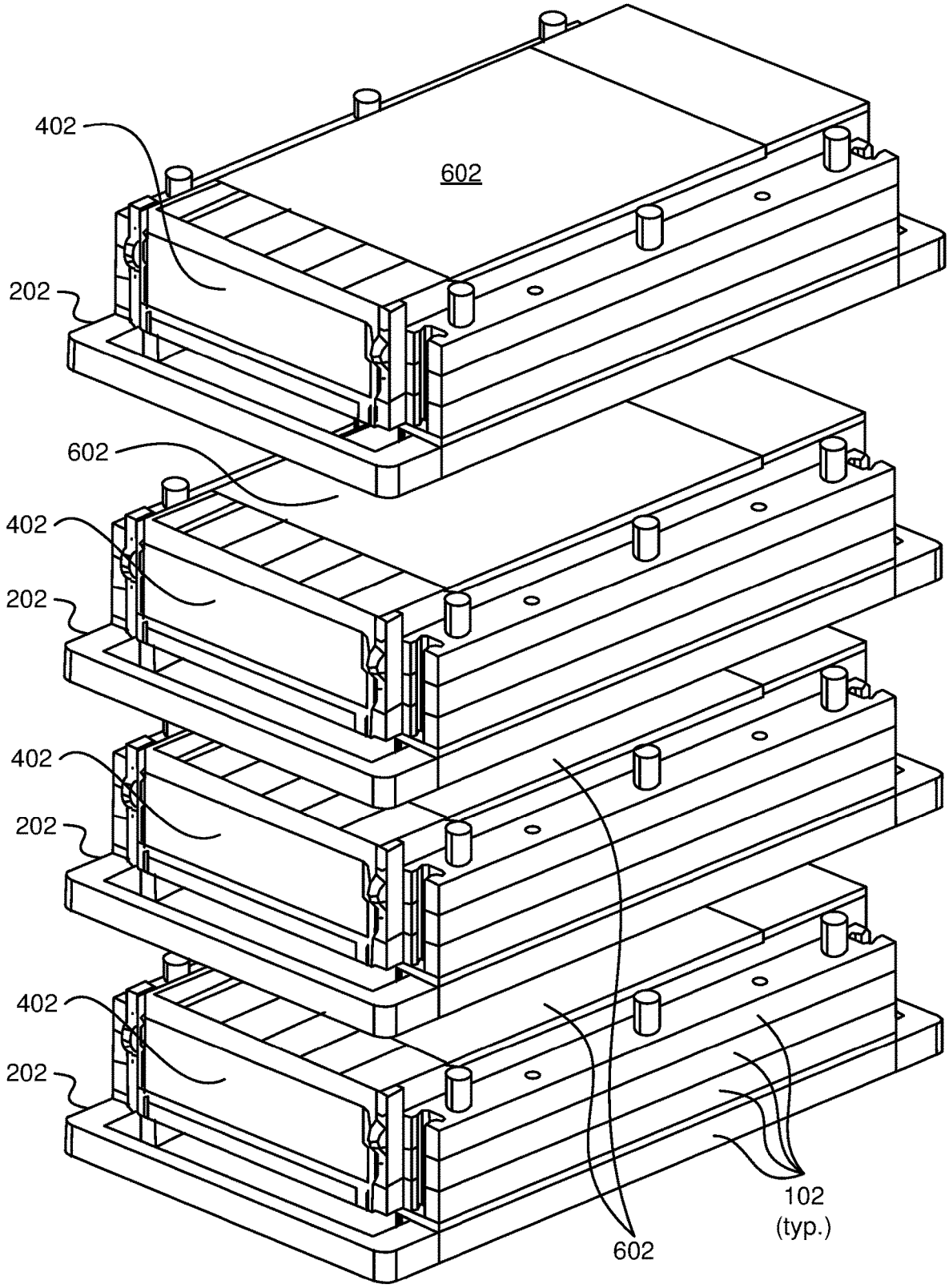
FIG. 6 is a perspective view diagram of side pieces, end pieces, and a top piece of a modular shipping container partially assembled and surrounding components.

FIG. 6 is a perspective view diagram of side pieces 102, end pieces 202, and a top piece 302 of a modular shipping container partially assembled and surrounding components 402. In the depicted embodiment, dividers 602 are placed between components 402. Each component 402 is surrounded by four layers of side pieces 102, and two end pieces 202 are on a bottom layer of the four layers. A divider 602 is depicted on each component 402. The divider 602, in some embodiments, is made of a material capable of maintaining spacing between components 402. In other embodiments, the divider 602 includes cushioning and may be partially crushable. For example, the divider 602 may be made of a material that will cushion expected impacts, vibration, etc. of the modular shipping container and/or components 402. The divider 602, in some embodiments, is selected based on weight of the components 402, expected impacts, and the like.

In some embodiments, a thickness of the divider 602 maintains a width between components 402 similar to spacing between components 402 when installed, such as in a rack. In some embodiments, the divider 602 extends at least partially between side pieces 102 and/or end pieces 202 to maintain a same gap between side pieces 102 and/or end pieces 202. In another embodiment, a separate divider (not shown) maintains a gap between side pieces 102 and/or end pieces 202.

FIG. 6 depicts four components 402 where each component is surrounded by side pieces 102 and end pieces 202. Pegs 104 protrude from the top of a top layer for a component 402 and corresponding bottom openings 114 in the bottom layer of a component 402 above can be aligned so that when the components 402, side pieces 102 and end pieces 202 are pressed together the pegs 104 fit into the bottom openings 114, as depicted in FIG. 7.

Figure 7:
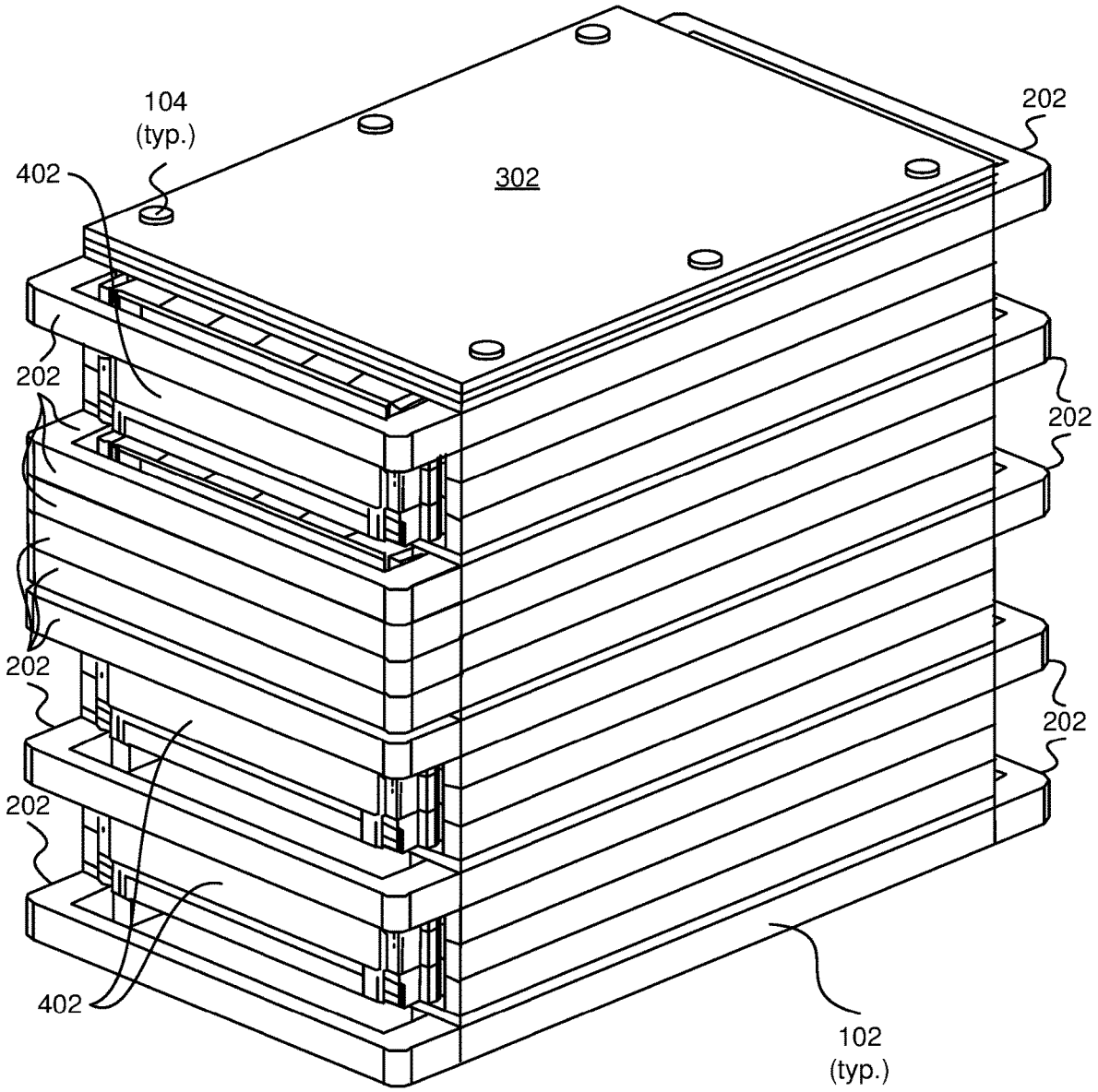
FIG. 7 is a perspective view diagram of side pieces, end pieces, and a top piece of a modular shipping container assembled and surrounding components.

FIG. 7 is a perspective view diagram of side pieces 102, end pieces 202, and a top piece 302 of a modular shipping container assembled and surrounding components 402. FIG. 7 is an assembled version of what is depicted in FIG. 6 except that a top piece 302 is added. A bottom piece 502 may be present but is not visible. Note that the pegs 104 extend through top openings 304 of the top piece 302. In the embodiment depicted in FIG. 7, a third component 402 from the bottom has end pieces 202 covering an end of the component 402, which may further protect the component 402. Other components 402 and ends of the components 402 do not include as many end pieces 202 where a single end piece 202 will protect the component 402 or where no end piece 202 is required.

Figure 8:
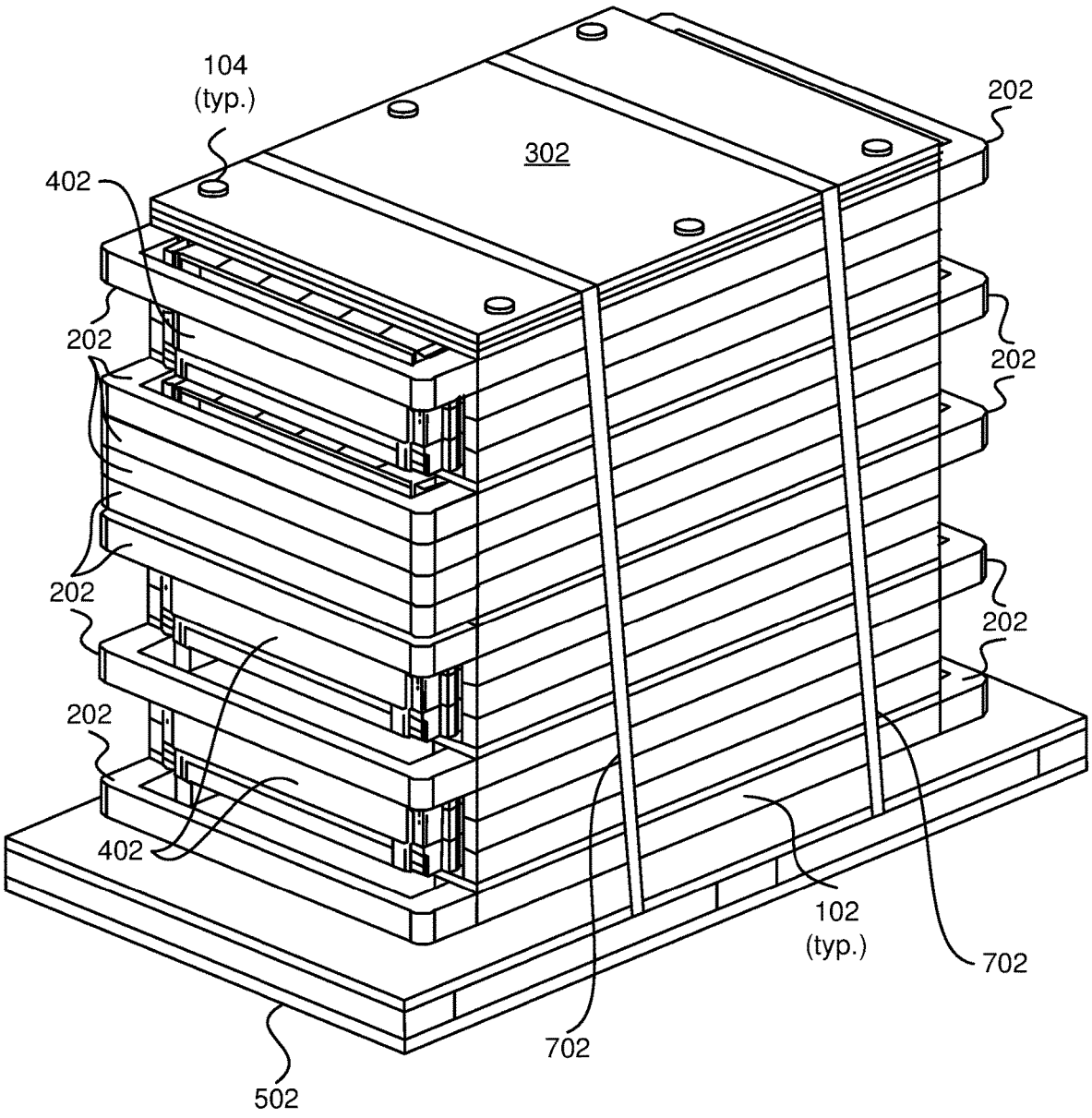
FIG. 8 is a perspective view diagram of side pieces, end pieces, a top piece and a bottom piece of a modular shipping container assembled and surrounding components and banded.

FIG. 8 is a perspective view diagram of side pieces 102, end pieces 202, a top piece 302 and a bottom piece 502 of a modular shipping container assembled and surrounding components 402 and banded. The bottom piece 502, in the depicted embodiment, is a pallet which extends beyond a footprint of the side pieces 102 and end pieces 202. In one embodiment, the bottom piece 502 is a standard pallet. In other embodiments, the bottom piece 502 is a standard pallet with another solid piece that fits under the bottom layer of side pieces 102 and/or end pieces 202. In other embodiments, the bottom piece 502 may fit within the footprint of the side pieces 102 and end pieces 202. The bottom piece 502 may be wood, plastic, metal or other material that will support the weight of the components 402 and modular shipping container pieces 102, 202, 302. One of skill in the art will recognize other materials and designs for a bottom piece 502 that will support the components 402 and modular shipping container pieces 102, 202, 302 during shipping.

In the embodiment, bands 702 extend around the side pieces 102 and top piece 302 and through openings in the bottom piece 502, which holds the modular shipping container together. The bands 702 may be metal, plastic or other material common for banding. In other embodiments, the bands 702 may be wire, rope, cord or other material. In other embodiments, the side pieces 102 connect together and the top piece 302 connects to the top layer of the modular shipping container so that banding is unnecessary. One of skill in the art will recognize other ways to keep the pieces 102, 202, 302, 502 of the modular shipping container together during shipping.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A modular shipping container comprising:

a plurality of side pieces positioned in a plurality of layers, wherein a layer of the plurality of layers comprises a layer of two side pieces of the plurality of side pieces, each side piece of the plurality of side pieces comprising two or more pegs protruding from a top of the side piece, each side piece comprising bottom openings in a bottom of the side piece, each bottom opening of a side piece of the plurality of side pieces sized and positioned to conform to and surround in a horizontal direction a peg of another side piece of the plurality of side pieces positioned below the side piece, wherein the horizontal direction is perpendicular to a vertical axis in a direction that the side pieces are stacked in layers; and one or more end pieces, wherein at least one layer of the plurality of layers of side pieces comprising two side pieces of the plurality of side pieces comprises at least one end piece, each end piece of the one or more end pieces on a layer comprising two ends and each end of the end piece shaped to attach to an end of a side piece of the two side pieces of the layer and shaped to maintain a specified width between the two side pieces of the layer, wherein a length of the side pieces maintain a specified length between the end pieces, wherein the plurality of layers of the plurality of side pieces comprises a specified height, and wherein each side piece of the plurality of side pieces is connectable to an end piece via an end opening and a conforming protrusion, wherein when the protrusion is inserted into the end opening, the side piece and end piece are connected to prevent the end piece from pulling away from the side piece.

2. The modular shipping container of claim 1, further comprising a top piece, the top piece comprising top openings sized and located to conform to and surround the pegs protruding from the top of two side pieces of the plurality of side pieces on a top layer, the top piece having a length that at least matches a length of each side piece of the plurality of side pieces.

3. The module shipping container of claim 2, wherein the top piece is sized to cover the side pieces and the end pieces of a layer of the plurality of layers comprising one or two end pieces.

4. The modular shipping container of claim 1, further comprising a bottom piece, wherein two side pieces of the plurality of side pieces of a bottom layer are attached to the bottom piece.

5. The module shipping container of claim 4, wherein each side piece of the plurality of side pieces comprises two or more vertical holes, and wherein the bottom piece is attached to the two side pieces of the bottom layer via the vertical holes.

6. The module shipping container of claim 4, wherein the bottom piece comprises one of a pallet adjacent to the two side pieces of the plurality of side pieces of the bottom layer and a planar element that fits between a pallet and the two side pieces of the plurality of side pieces of the bottom layer.

7. The module shipping container of claim 1, wherein each end opening for connecting a side piece of the plurality of side pieces with an end piece of the one or more end pieces extends vertically through one of the side piece and the end piece and the corresponding protrusion is shaped to slide vertically into the end opening to conform to the end opening to prevent movement of the end piece away from the side piece.

8. The modular shipping container of claim 1, wherein a joint between a side piece of the plurality of side pieces and an end piece of the one or more end pieces of a layer comprises an exposed lip at an end of the side piece.

9. The modular shipping container of claim 1, wherein each side piece is configured to fit on either side of an end piece.

10. The modular shipping container of claim 1, wherein each end piece of the one or more end pieces is configured to fit on either end of a side piece.

11. The modular shipping container of claim 1, wherein an assembled modular shipping container comprises a bottom piece, two or more layers, each layer comprising at least two side pieces of the plurality of side pieces, and a top piece and further comprising one or more bands that extend from the bottom piece around the side pieces and top piece and hold the top piece and side pieces to the bottom piece.

12. The modular shipping container of claim 1, wherein each end piece of the one or more end pieces is configured to extend away from a connected side piece creating a cable space.

13. The modular shipping container of claim 12, wherein the end piece of the one or more end pieces comprises a cable attachment configured to secure a cable to a side of the end piece.

14. A modular shipping container comprising:

two or more layers, each layer comprising two side pieces of a plurality of side pieces, each side piece of the plurality of side pieces comprising two or more pegs protruding from a top of the side piece, each side piece of the plurality of side pieces comprising bottom openings in a bottom of the side piece, each bottom opening of a side piece of the plurality of side pieces sized and positioned to conform to and surround in a horizontal direction a peg of a side piece of the plurality of side pieces positioned below the side piece, wherein the horizontal direction is perpendicular to a vertical axis in a direction that the side pieces are stacked in layers;

a top piece comprising top openings sized and located to conform to and surround in the horizontal direction the pegs protruding from the top of the two side pieces of the plurality of side pieces on a top layer of the two or more layers, the top piece having a length that at least matches a length of each side piece of the plurality of side pieces and wherein a width of the of openings of the top piece maintains a specified width between the plurality of side pieces; and an end piece on a same layer of the two or more layers as two side pieces of the plurality of side pieces, the end piece comprising two ends and each end of the end piece is shaped to attach to an end of a side piece of the two side pieces of the same layer and shaped to maintain the specified width between the two side pieces and wherein a height of the end piece matches a height of the side pieces, wherein a length of the side pieces maintain a specified length between the end pieces, and wherein the plurality of layers of the plurality of side pieces comprises a specified height.

15. The modular shipping container of claim 14, further comprising a bottom piece, wherein the two side pieces of the plurality of side pieces of a bottom layer of the two or more layers are attached to the bottom piece, wherein the bottom piece comprises one of a pallet adjacent to the two side pieces of the bottom layer and a planar element that fits between a pallet and the two side pieces of the bottom layer, and further comprising one or more bands extending around the plurality of side pieces and the top piece securing the plurality of side pieces and top piece to the bottom piece.

16. The modular shipping container of claim 14, wherein a joint between a side piece of the plurality of side pieces and an end piece of a layer of the two or more layers comprises an exposed lip at an end of the side piece.

17. A modular shipping container comprising:

a plurality of side pieces positioned in a plurality of layers, wherein a layer of the plurality of layers comprises a layer of two side pieces of the plurality of side pieces, each side piece of the plurality of side pieces comprising two or more pegs protruding from a top of the side piece, each side piece of the plurality of side pieces comprising bottom openings in a bottom of the side piece, each bottom opening of a side piece of the plurality of side pieces sized and positioned to conform to a peg of a side piece of the plurality of side pieces positioned below the side piece;

one or more end pieces, wherein at least one layer of the plurality of layers of side pieces comprising two side pieces of the plurality of side pieces comprises at least one end piece, each end piece of the one or more end pieces comprising two ends and each end of the end piece shaped to attach to an end of a side piece of the two side pieces of the layer and shaped to maintain a specified width between the two side pieces of the layer, wherein each side piece of the plurality of side pieces connects to an end piece of the one or more end pieces via an end opening and a conforming protrusion, wherein when the protrusion is inserted into the conforming protrusion, the side piece and end piece are connected to prevent the end piece from pulling away from the side piece, wherein a length of the side pieces maintain a specified length between the end pieces;

a top piece, the top piece comprising top openings sized and located to conform to and surround the pegs protruding from the top of the two side pieces of the plurality of side pieces on a top layer of the plurality of layers, the top piece having a length that at least matches a length of each of the side pieces of the plurality of side pieces; and a bottom piece, wherein the two side pieces of the plurality of side pieces of a bottom layer of the plurality of layers are attached to the bottom piece, wherein each side piece of the plurality of side pieces comprises two or more vertical holes, where the bottom piece is attached to the two side pieces of the bottom layer via the vertical holes, wherein a joint between a side piece of the plurality of side pieces and an end piece of the one or more end pieces of a layer comprises an exposed lip at an end of the side piece, and wherein the plurality of layers of the plurality of side pieces comprises a specified height.

* * * * *